US005720108A

United States Patent [19]

Rice

[11] Patent Number: 5,720,108

[45] Date of Patent: Feb. 24, 1998

[54] PORTABLE DRYER FOR BOOTS AND GLOVES

[76] Inventor: Russell Rice, 170 Mesquite Dr., Edwards, Colo. 81632

[21] Appl. No.: 555,721

[22] Filed: Nov. 14, 1995

[51] Int. Cl.[6] ..... F26B 25/00

[52] U.S. Cl. ..... 34/104

[58] Field of Search ..... 34/60, 104, 106, 34/168, 177, 210, 222, 224; D32/58, 59; 223/51, 70, 73, 76

[56] References Cited

U.S. PATENT DOCUMENTS

| | | | |
|---|---|---|---|
| 2,443,695 | 6/1948 | Russell . | |
| 2,448,834 | 9/1948 | Rousseau | 34/666 |
| 2,614,337 | 10/1952 | Darbo . | |
| 3,154,392 | 10/1964 | Littman . | |
| 3,417,482 | 12/1968 | Peet . | |
| 3,645,009 | 2/1972 | Ketchum | 34/104 |
| 4,145,602 | 3/1979 | Lee | 219/370 |
| 4,171,580 | 10/1979 | Vabrinskas | 34/104 |
| 4,198,765 | 4/1980 | Miyamae | 34/104 |
| 4,768,293 | 9/1988 | Kaffka | 34/104 |
| 5,003,707 | 4/1991 | Chu | 34/104 |
| 5,289,642 | 3/1994 | Sloan | 34/104 |
| 5,379,525 | 1/1995 | Raynor | 34/104 |

*Primary Examiner*—John M. Sollecito
*Assistant Examiner*—Steve Gravini
*Attorney, Agent, or Firm*—James R. Young, Scott B. Allison, Chrisman, Bynum & Johnson

[57] ABSTRACT

A drying device for warming or drying boots, gloves, mittens, and other articles has a pair of flexible hoses attached to an air blower and manifold. The remaining end of each hose is inserted into a boot or glove to facilitate warming or drying the inside of the boot or glove when air is forced through the flexible hoses by the air blower and the duct assembly. The length of the each flexible hose is independently adjustable so that the invention can be used with a variety of boot and glove sizes. Optional nozzles at the ends of the flexible hoses direct the air being blown into the boots, gloves, mittens, or other articles toward specific areas of the boots, gloves, mittens, or other articles. A spring clip is positioned inside the flexible hoses to help direct the flexible hoses into the boots or gloves to be dried and to keep the boots, gloves, mittens, or other articles held together. The flexible hoses and the clip are removeable from the air blower and are sized to enable them to be stored in one boot while the slim design and size of the air blower enables it to be stored in another boot.

33 Claims, 4 Drawing Sheets

PORTABLE DRYER FOR BOOTS AND GLOVES

BACKGROUND OF THE INVENTION

1. Field of the Invention

The invention relates generally to an apparatus for drying gloves and boots and, more particularly, to a small and light weight drying apparatus for use with a variety of glove and boot sizes wherein the invention can also be partially disassembled for convenient portability and storage.

2. Description of the Prior Art

It is very common for boots, gloves, mittens, and other similar outdoor clothing items to become wet or damp during use, especially boots and gloves used for keeping feet and hands warm and dry during winter activities, such as sledding or snow skiing. In order to increase the useful life and the comfort of boots or gloves, it is desirable to completely dry the inside of the boots and gloves after they are used and before they are stored away or used again. There have been numerous blowing and drying devices invented for this purpose of drying shoes, boots, mittens, and gloves. For example, see U.S. Pat. No. 4,768,293 issued to Kaffka, U.S. Pat. No. 4,198,765 issued to Miyamae, U.S. Pat. No. 4,145,602 issued to Lee, U.S. Pat. No. 3,645,009 issued to Ketchum, U.S. Pat. No. 3,417,482 issued to Peet, U.S. Pat. No. 3,154,392 issued to Littman, U.S. Pat. No. 2,614,337 issued to Darbo, and U.S. Pat. No. 2,443,695 issued to Russell.

In various prior art drying devices, however, there are still problems. Easy insertion of heater elements or components far enough into the boot or glove to maximize drying efficiency while at the same time being able to accommodate a variety of boot and glove sizes has remained a problem. For example, the shoe dryer disclosed in Miyamae discloses a shoe dryer that includes flexible blow pipes, which ease insertion through curves into shoes, but the lengths of the blow pipes are not adjustable, so different sized shoes are not easily accommodated. The dryer disclosed in Kaffka, on the other hand, includes adjustable length discharge tubes that are adjustable in length, but these discharge tubes are not flexible and are inconvenient and not adaptable to insertion into the lower extremities of boots, especially stiff boots.

Space requirement has have also been a problem in the prior art drying devices. For example, the dryers disclosed in Kaffka, Lee, Peet, Ketchum, Littman, and Russell each require separate storage space when they not being used. They also are not very convenient for toting to remote locations, such as to ski resorts or hunting lodges, because they add another device to be held and juggled during travel along with all the myriad of other pieces of equipment needed on a skiing or hunting trip.

A further problem that exists with many prior art drying devices, including the dryers disclosed in Lee, Ketchum, and Russell patents, is that the gloves or boots being dried with those devices are not securely attached to the drying devices. Therefore, the boots or gloves are too easily dislodged or separated from these drying devices if the boots, gloves, or drying device are jostled or dislocated.

Finally, many prior art drying devices do not have the capability to allow the air being blown into a boot or glove to be directed toward a specific part of the inside of the glove or boot, such as, for example, the toe, heel, bottom, side, or inside instep of a boot. For example, the dryers disclosed in Miyamae, Lee, Ketchum, Littman, Darbo, and Russell have limited or no ability to direct the flow of air to specific areas of the boots or gloves. Furthermore, these prior art drying devices do not have the capability to easily change the direction of the air flow in the boots or gloves from, for example, the toe of a boot to the heel of a boot.

SUMMARY OF THE INVENTION

It is a general object of this invention to provide a drying device that can be used for drying or warming the insides of boots, gloves, mittens, and other clothing articles used for protecting extremities of a person's body in snow or inclement weather.

It is another general object of this invention to provide a drying device that can be used for drying a variety of boots, gloves, mittens, and other clothing articles having a variety of sizes, shapes, and dimensions.

It is specific object of this invention to provide a drying device where the lengths of the elements inserted into the boots, gloves, mittens, and other clothing articles are adjustable.

It is another specific object of this invention to provide a drying device where the flow of air into the boots, gloves, mittens, and other clothing articles can be directed specifically toward certain areas in the boots, gloves, mittens, and other clothing articles.

Another specific object of this invention is to provide a drying device where the elements inserted into the boots, gloves, mittens, and other clothing articles are flexible so as to facilitate insertion.

Another general object of this invention is to provide a drying device where the boots, gloves, mittens, and other clothing articles being dried are held firmly together.

A further general object of this invention is to provide a drying device wherein the drying device can be easily partially disassembled, thereby making it easier to carry and store the drying device.

Additional objects, advantages, and novel features of the invention shall be set forth in part in the description that follows, and in part will become apparent to those skilled in the art upon examination of the following or may be learned by the practice of the invention. The objects and the advantages may be realized and attained by means of the instrumentalities and in combinations particularly pointed out in the appended claims.

To achieve the foregoing and other objects and in accordance with the purposes and objects of the present invention, as embodied and broadly described therein, the drying device of the present invention includes an air blower having an air inlet port, and an air outlet port. A duct assembly is connected to the outlet port of the air blower. The duct assembly includes a manifold with an inlet connected to the outlet port of the air blower and two air outlet ports. Two hoses or ducts for insertion into the boots, gloves, mittens, or other clothing article to be dried are connected at their proximal ends to the outlet ports of the manifold to carry the air into the boots, gloves, mittens, or other clothing article being dried. Each hose or duct is preferably flexible and is, preferably, threaded and the air outlet ports of the manifold are also threaded so as to mate with the flexible hoses or ducts. Therefore, each flexible hose or duct can be threaded or screwed into and out of the duct assembly for easy adjustment rotationally or longitudinally as well as for easy assembly or disassembly as desired. Nozzles for directing air flow and for easing insertion of the ducts into boots or gloves are also adjustably threaded on the distal ends of the flexible hoses in a manner that allows rotational and longitudinal adjustment of the nozzles on the ducts. The duct assembly is preferably detachable from the blowing assembly. A generally inverted U-shaped clip inside the duct assembly with spring biased prongs extending into the flexible hoses biases the flexible hoses toward each other. Therefore, the duct assembly can be clamped in place on a pair of boots or a pair of gloves can be clamped to the duct assembly by the spring biased hoses or ducts. While the U-shaped clip partially reduces the flexibility of the flexible hoses, the hoses are still partially movable and bendable to permit easy insertion of the flexible hoses into the boots or gloves. The addition of the U-shaped clip allows the boots or gloves being dried to be securely attached to the drying apparatus.

The air blower and duct assembly preferably have flat top surfaces that provide a stable base for supporting the dryer in an inverted position with the ducts extending upwardly for supporting gloves, socks or other clothing articles being dried that do not have structural rigidity to support themselves. An optional stand can be placed around the air blower or the duct assembly to further stabilize the drying device when it is being used to dry gloves, mittens, etc. or is otherwise positioned so that the air blower and the duct assembly are positioned adjacent a supporting surface such as a table or desk.

BRIEF DESCRIPTION OF THE DRAWINGS

The accompanying drawings, which are incorporated in and form a part of the specifications, illustrate the preferred embodiments of the present invention, and together with the descriptions serve to explain the principles of the invention. In the Drawings.

DETAILED DESCRIPTION OF THE PREFERRED EMBODIMENTS

Figure 1:
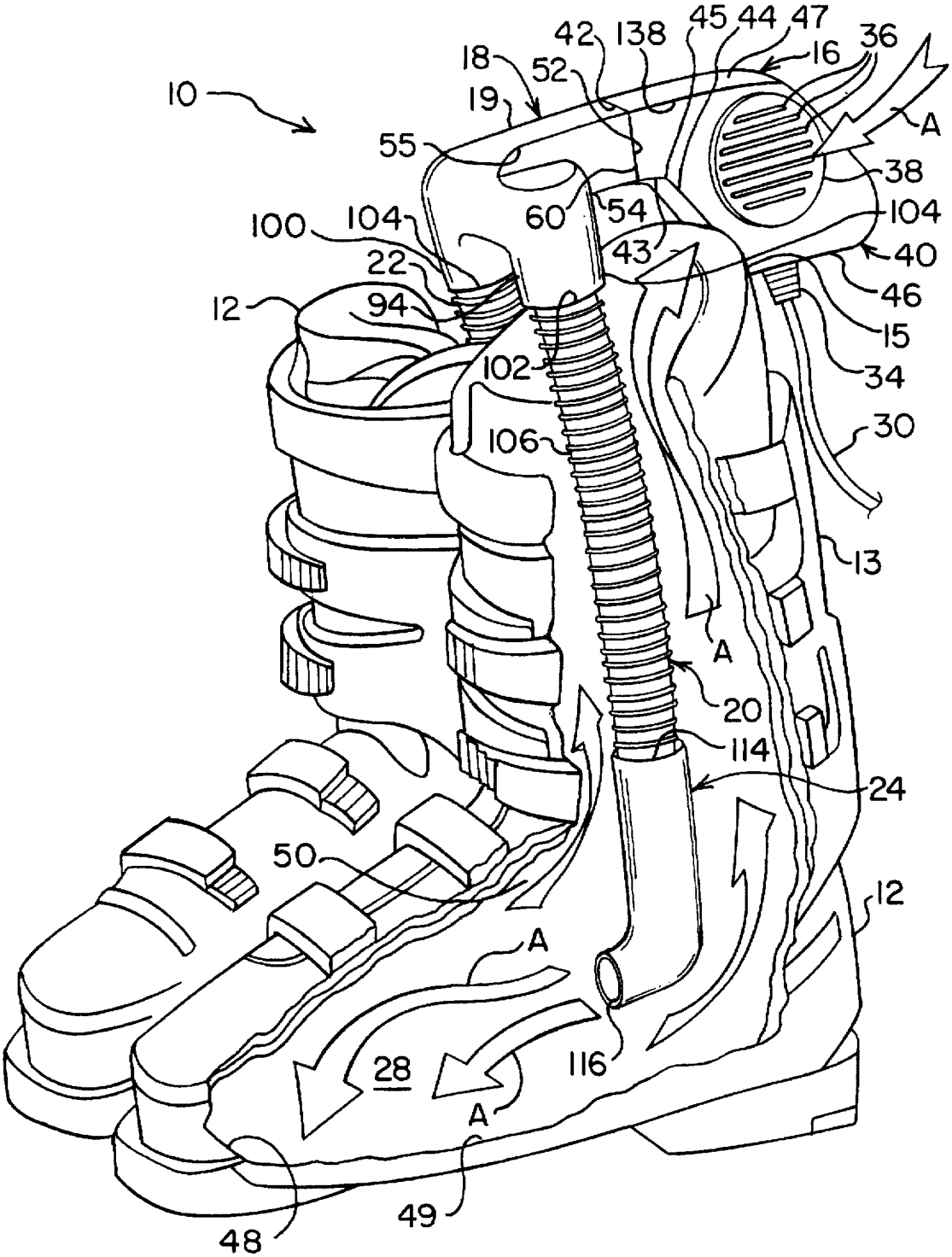
FIG. 1 is an isometric view of the drying device of the present invention mounted on a pair of boots with the side of one of the boots cut away to reveal the position and orientation of one of the air ducts inserted into the interior of the boot as it is to warm and dry boots.
Figure 2:
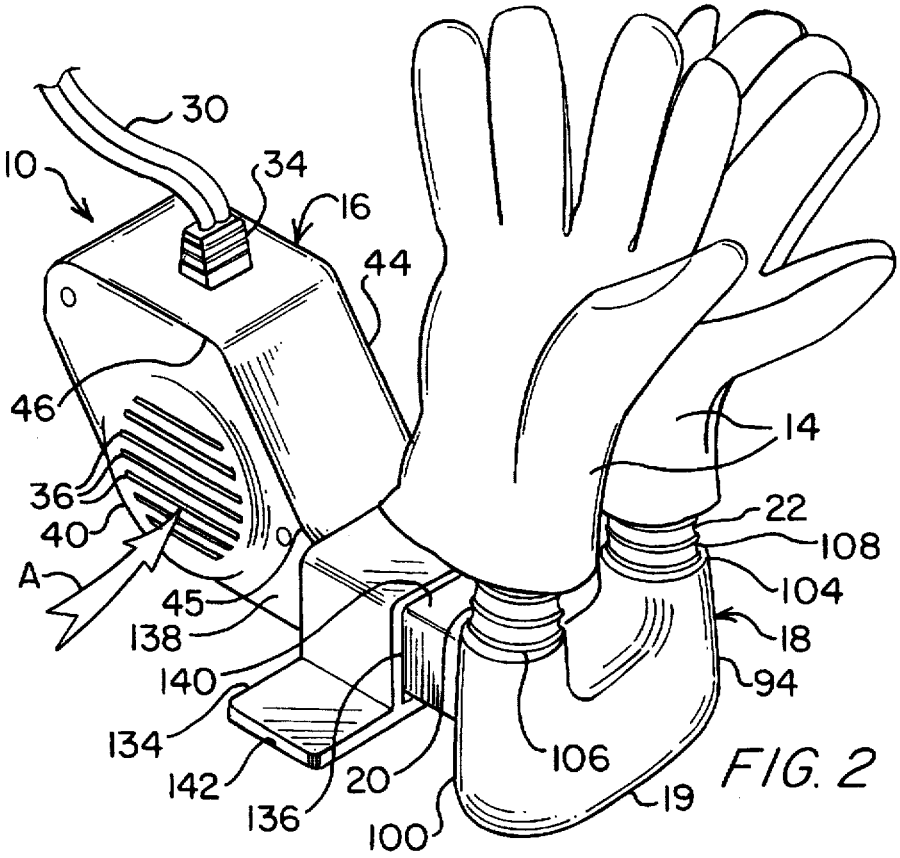
FIG. 2 is an isometric view of the drying device of FIG. 1, but in the inverted position that is preferred to warm and dry gloves.
Figure 3:
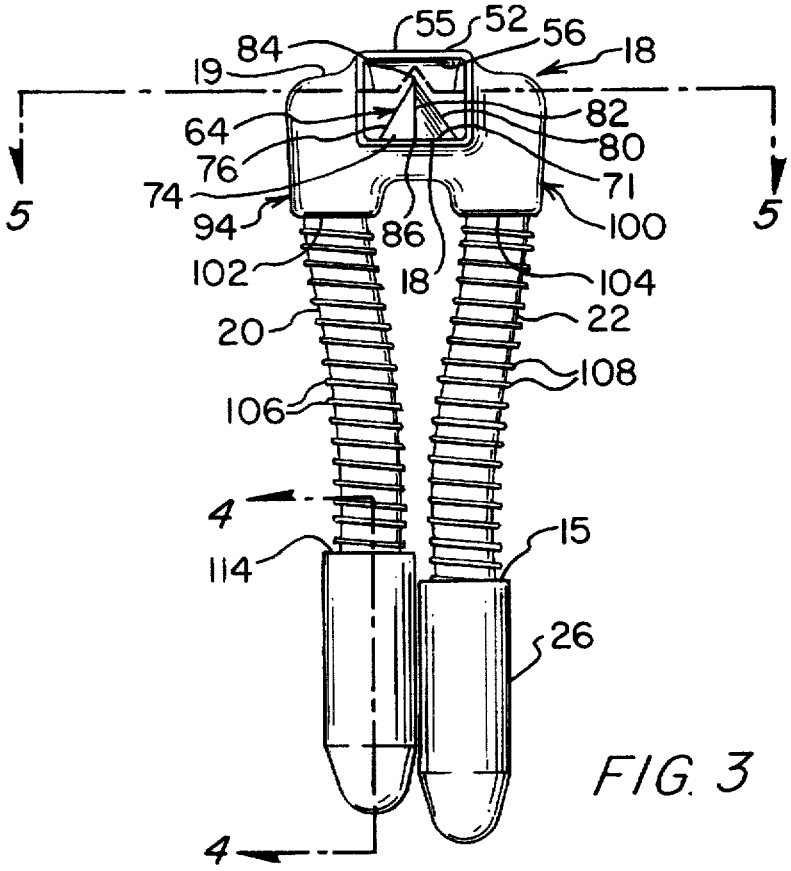
FIG. 3 shows an elevation view of the duct assembly of the drying device of FIG. 1 removed from the heater/blower assembly.

The drying device 10 of the present invention is shown in FIG. 1 mounted on a pair of boots 12 and in FIG. 2 supporting a pair of gloves 14. The drying device 10 shown in FIG. 1 is being used to dry the boots 12 and preferably includes a heater/air blower assembly 16 for producing a blowing stream of hot air A, and a duct assembly 18. The duct assembly 18 includes a manifold 19 for splitting the air stream from the air blower assembly 16 into two streams. A pair of hoses or duct tubes 20, 22 conduct the two air steams A from the manifold 19 to the interiors of a pair of boots, gloves, or other clothing articles to be dried, and optional nozzles 24, 26 (only nozzle 26 is shown in FIG. 3) for directing the air stream A in the boots 12 or gloves 14. The air stream A discharged through hose nozzles 24, 26 circulates within the interior of the boots 12 or gloves 14 before exiting, thus warming and drying the inside 28 of the boots 12 or gloves 14.

Figure 7:
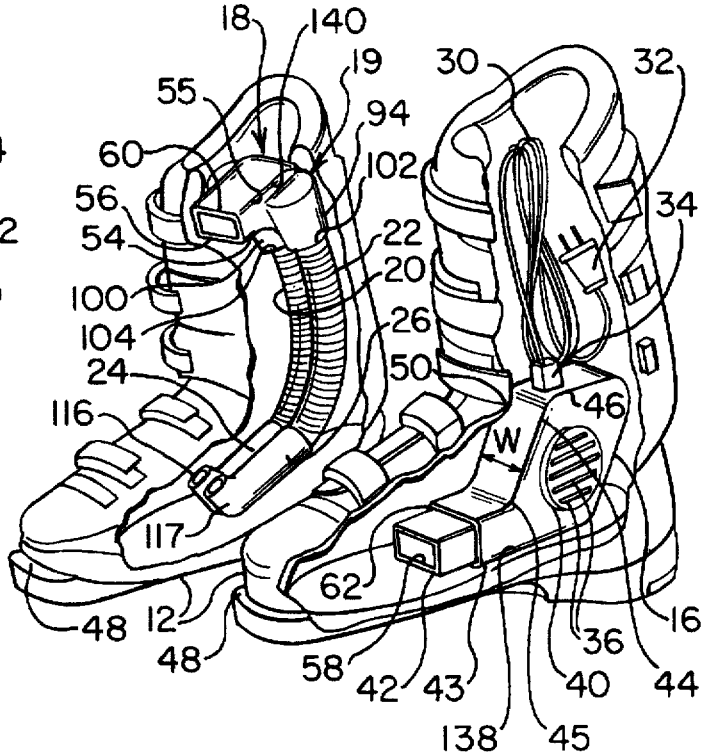
FIG. 7 is an isometric view of the drying device of FIG. 1 disassembled for storage or toting in a pair of boots.

A significant feature of this invention is the ducts 20, 22 being resiliently biased toward each other for clamping boots or gloves between them. This feature secures the dryer device 10 to a pair of boots, as shown in FIG. 1, as it holds the boots together during drying. The boots clamped together to the ducts 20, 22 make a stable unit with the dryer device 10 during drying that is not easily toppled or dislodged by pets or small children. While there are many ways to resiliently bias the ducts toward each other, as will be recognized by persons skilled in the art once the purpose of such resilient bias is known and understood from this description, a preferred apparatus includes a forked, resilient spring clip 122 disposed in the manifold 19 and extending a substantial distance into the flexible duct tubes 20, 22 to bias the duct tubes 20, 22 toward each other, as shown in FIG. 7. This spring bias binds the boots 12 together and at the same time tightens the air duct assembly 18 onto the boots 12 to mount and support the air blower assembly 16, as shown in FIG. 1. It also clamps other clothing articles, such as the gloves 14 in FIG. 2 snugly on the air duct assembly 18 so that they do not fall and cannot easily be brushed off or dislodged accidentally, such as by a child or pet, during drying. Another significant feature of this invention is the flat top surfaces 55, 47 of the manifold 19 and air blower 16 (FIG. 1), which can be used as a support surface for the dryer device 10 inverted as shown in FIG. 2 when it is used to support gloves 14 or other clothing articles. A stand 134 with extended legs surface 142 shown in FIG. 9 can also be used to extend a flat surface laterally for additional support and stability, as illustrated in FIG. 2. These features, as well as others, such as the air flow divider feature of the manifold 19, will be described in more detail below.

The air blower 16 comprises a blower motor (not shown) and fan (not shown) for blowing air and preferably a heating element (not shown) for heating the air. Such blower motors, fans, and heating elements are well-known in the art and do not comprise this invention other than as a source of an air stream that may or may not be heated. Therefore, it is not necessary to show or describe any particular blower motor, fan, or heating element for a description and understanding of this invention. The air blower 16 can be powered by batteries (not shown) or, when heated air over extended periods of time is needed, it may be preferable to use a source of domestic electricity, such as a standard 120-volt outlet (not shown) in a house. When the air blower 16 is powered by a domestic electricity source, an electric cord 30 (shown in FIGS. 1, 2, and 7) having an electric cord plug 32 (shown in FIG. 7) is electrically attached to the air blower 16 by an appropriate cord attachment 34 as is well-known by persons skilled in the art of making blow dryers and need not be described in any further detail for purposes of this invention. The air blower 16 preferably includes an on/off switch (not shown) to activate the motor (not shown) so that air A enters the air blower 16 through the slots 36 in the air blower entry ports 38, 40 and is forced to flow through or across an optional heating element (not shown) in the air blower 16 to warm the air A before the air A exits the air blower 16 at the air blower outlet port 42 at the end of the air flow extension 43. A separate switch (not shown) can be provided to activate or deactivate the heating element and is well-known to persons skilled in the art.

While the air blower 16 preferably has a housing 40 for the motor, fan, and heater element comprising a light weight plastic material that is a poor heat conductor but has substantial structural strength, the air blower 16 can comprise any other material having sufficient rigidity and sufficient thermal characteristics to withstand heat produced within the air blower 16. In addition, the air blower 16 preferably has a size and dimensions so that it will fit easily into a small space, such as a boot 12, as shown in FIG. 7. More specifically, the housing 40 of air blower 16 preferably has a narrow width W and includes a sloped housing surface 44 between the end 45 of the air flow extension 43 and the surface 46 of the air blower 16 so that air blower outlet port 42 can be inserted into the shaft 13 of the boot 12 and easily positioned toward the toe end 48 of the foot 49 the boot 12, while the sloped housing surface 44 is positioned approximately in the bend 50 of the boot 12 that covers a person's ankle. The air blower 16 also preferably includes a substantially flat top surface 47, as shown in FIG. 1, which is useful as a support surface when the drying device 10 is used in an inverted position to support and dry the gloves 14 illustrated in FIG. 2 or other clothing articles that lack the structural rigidity to support themselves in an upright or extended position for drying, as will be discussed in more detail below.

Figure 6:
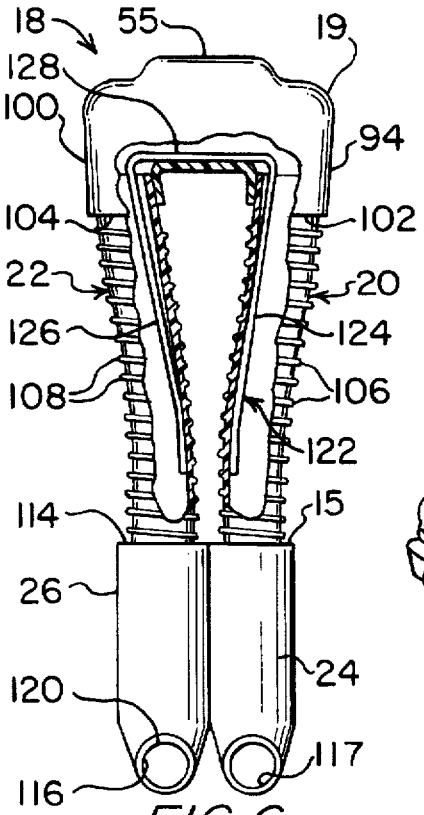
FIG. 6 is a view of the duct assembly of the drying device of FIG. 1 similar to the view in FIG. 3, but with a portion of the duct tubes and manifold cut away to reveal the inverted U-shaped spring clip used to clamp the drying device in drying position or to clamp a pair of gloves to the drying device on a pair of boots.

Referring now to FIG. 1, the air duct assembly 18 mounts on the extension or barrel 43 portion of the housing 40 of air blower 16 so that the air exiting the air blower 16 at the air blower outlet port 42 of barrel 43 enters the air duct assembly 18 at the air duet inlet port 52 of air inlet extension 54 of manifold 19. For quick mounting, the air duct inlet port 52 preferably has an inner surface 56 (see FIGS. 3, 6) that slides over the outer surface 58 (see FIG. 7) of the air blower barrel 40 so that the inner surface 56 of the air duct inlet port 52 fits snugly but slidably over the outer surface 58 of the air blower outlet port 42, until the end 60 (see FIGS. 3, 6, and 7) of the air duct inlet pert 52 abuts the shoulder 62 (see FIG. 7) on the barrel 43, as shown in FIG. 1. In addition, the top surface 47 of the air blower 16 is preferably in a common plane aligned with the top surface 55 of the air duct assembly 18 so that the top surface 47 and the top surface 55 form one continuous and substantially flat support surface for supporting the dryer device 10 in an inverted position to dry gloves 14 and other clothing articles, as shown in FIG. 2. While the air blower outlet port 42 and the air duct inlet port 52 preferably have a rectangular cross-sectional shape, they can have a circular shape, an oval shape, a triangular shape, or any other shape that conducts air and has the structural integrity needed to support the air duct assembly 18 on the air blower 16. While the manifold 19 of the air duct assembly 18 is preferably fabricated with a light weight plastic material, it can comprise any other material that has sufficient rigidity and sufficient thermal characteristics to withstand any heat produced by the air blower 16.

Figure 5:
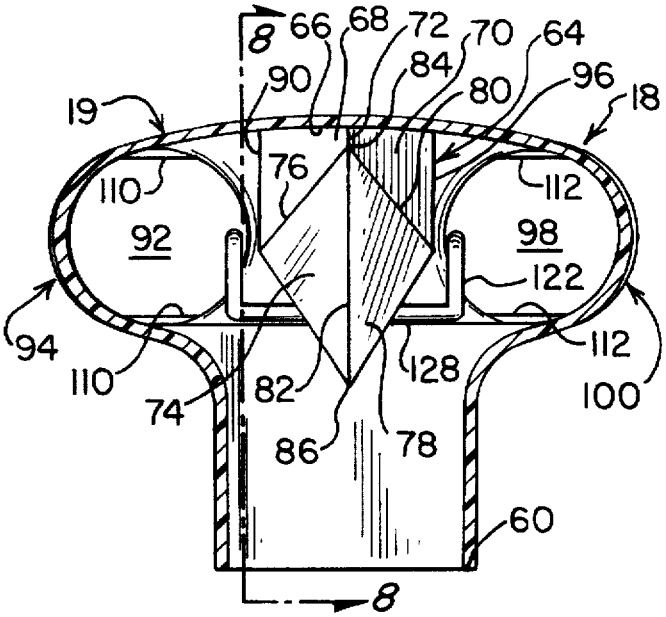
FIG. 5 is a cross-sectional view of the duct assembly of the drying device of FIG. 1 taken along the section line 5—5 of FIG. 3.
Figure 8:
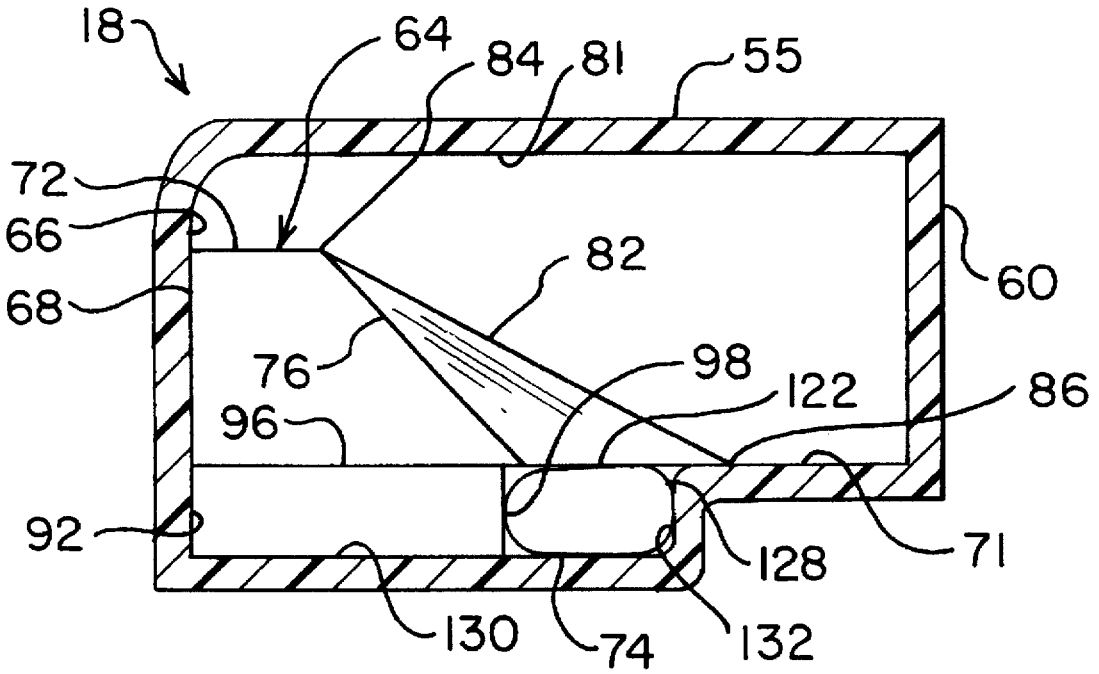
FIG. 8 is a cross-sectional view of the manifold portion of the duct assembly, taken along the line 8—8 of FIG. 5 to show the air deflector or divider.

Referring now to FIGS. 3, 5, and 8, the manifold 19 of the air duct assembly 18 has an air deflector or divider 64 protruding inwardly from the back wall 66 of the manifold 19 for dividing air flow from the air blower 16 into two separate air flows and directing them respectively into the two duct tubes 20, 22. The air deflector 64 includes two angled surfaces 68, 70 that diverge downwardly and outwardly from ridge 72 a spaced distance under the roof 81 of manifold 19 to the floor 71 of manifold 19 adjacent ports 92, 98, respectively, where the manifold 19 divides into two spaced-apart outlet tubes 94, 100. These surfaces 68, 70 extend from the back wall 66 of the manifold 19 inwardly toward but not to the end 60 of the air duct inlet port 52, which was described above. The air deflector 64 also has another pair of surfaces 74, 78 that converge from the inward extremities of angled surfaces 68, 70 inwardly and downwardly to a point 86 on floor 71. An edge 82 is formed by the intersection of surfaces 68, 74 and extends downwardly and toward, but not to, the end 60 of the air duct entry port 52 and terminates at the point 86. An edge 76 is formed at the intersection of surfaces 68 and 74 and extends downwardly and outwardly from a point 84 at the inward extremity of ridge 72 to the floor 71. Likewise, an edge 80 is formed at the intersection of the surfaces 70 and 78 and extends downwardly and outwardly in the opposite direction from the point 84 to the floor 71. The air deflector 64 has a width so that the lower edge 90 of the surface 68 where it intersects floor 71 is adjacent the port 92 of the outlet tube 94 and so that the edge 96 of the surface 70 where it intersects floor 71 is adjacent the port 98 of the air duct tube 100.

The hoses or ducts 20, 22 attach to the outlet ends 102, 104 of the ports 92, 98 in manifold tubes 94, 100, respectively. The ports 102, 104 are preferably perpendicular to the air duct entry port 52. The outlet ends 102, 104 of air duct tubes 94, 100 are preferably circular as best shown in FIGS. 1, 2, and 5, to facilitate connection to the flexible hoses 20, 22. The ducts 20, 22 are preferably, but not necessarily, somewhat flexible and may comprise a light weight plastic, rubber, or other suitable material, although they can comprise any other material having sufficient thermal characteristics to withstand any heat produced by the air blower 16.

The ducts or hoses 20, 22 are threaded on the outside surfaces with the continuous threads 106, 108, respectively, as shown in FIGS. 1, 2, 3, 6, and 7. The threads 106, 108 on the ducts 20, 22 enable the ducts 20, 22 to be easily attached and detached from to the air duct hoses 94, 100, respectively, by threading the ducts 20, 22 into the outlet ends 102, 104, respectively. The threads 106, 108 on the ducts 20, 22 mate with the threads 110, 112 (see FIG. 5) protruding from the inside surfaces of the air duct outlet ports 92, 98. Each outlet port 92, 98 preferably includes at least one pair of dramatically opposing incised threads 110, 112, respectively, on its inside surface, although more incised threads (not shown) would provide an even more secure attachment of the ducts 20, 22 to the outlet ports 92, 98 of the manifold air duct tubes 94, 100. When the ducts 20, 22 are attached to the manifold air duct tubes 94, 100, of the air duct assembly 18, as described above, the ducts 20, 22 depend outward from the manifold 19 at an angle substantially perpendicular to the top surface 55 of the air duct assembly 18.

Figure 4:
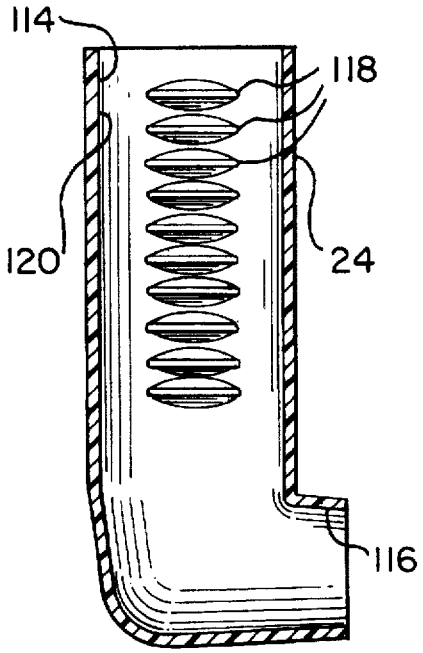
FIG. 4 is an enlarged cross-sectional view in elevation of a threaded discharge nozzle of the drying device of FIG. 1 taken along section line 4—4 of FIG. 3.

Optional nozzles 24, 26, respectively, can be attached to the outlet ends of ducts 20, 22, as shown in FIGS. 1, 3, 6, and 7, for assisting in non-snag insertion of the ducts 20, 22 into boots, gloves, or other clothing articles as well as directing the flow of air into the boots, gloves, or other clothing articles, as illustrated in FIG. 1. Since the nozzles 24, 26 are identical, only nozzle 24 will be described in further detail below. Referring now primarily to FIG. 4 as well as to FIGS. 1, 3 and 6, the nozzle 24 is preferably L-shaped and includes an entry end 114 and an outlet port 116. The nozzle 24 also includes the raised threads 118 molded on the inside surface 120 of the nozzle 24 so that the nozzle 24 can be attached to the flexible duet 20 by threading or screwing the flexible hose 20 into the port 114 of the nozzle 24.

While the nozzles 24, 26 preferably comprise a plastic material, it can comprise any other material having sufficient rigidity and sufficient thermal characteristics to withstand any heat produced by the air blower 16. In addition, while the nozzle 24 is preferably L-shaped, the nozzle 24 can have other shapes and can include holes (not shown) or other outlets (not shown) so that air A flowing into the nozzle 24 at the cap entry port 114 exits the nozzle 24 at a variety of places. In addition, the nozzle 24 can have an exit port (not shown) that is rotatable or otherwise adjustable so as to increase the operational configurations of the drying device 10. The nozzle 24 should also have smoothly contoured surfaces to avoid snags as the nozzle 24 and the duct 20 are being inserted into the boot, glove, or other clothing article.

In the preferred embodiment, the drying device 10 includes an inverted U-shaped resilient spring clip 122 that extends from the manifold 19 into both of the flexible hoses 20, 22 for biasing the ducts 20, 22 toward each other, although any other structure that resiliently biases the ducts 20, 22 toward each other with sufficient force to clamp boots 12 together or to clamp gloves 14 on the duct assembly 18 would be satisfactory for this feature of this invention. This feature has the effect of clamping the air duct assembly 18 securely to a pair of boots 12, as shown in FIG. 1 or to clamp other clothing articles, such as the gloves 14, to the air duct assembly 18, as shown in FIG. 2. The air dryer device 10, with or without the spring bias in the ducts is quite stable mounted on the boots 12, as shown in FIG. 1, because the ducts 20, 22 extend into the shafts 13 of boots 12 while the conduit neck formed by manifold inlet extension 58 and barrel 43 extends over the upper rim 15 of boot shaft 13 where the housing 40 widens and extends below the rim 15 on the outside of the shaft 13 of boot 12. The upper rim 15 of the boot 12 can support the dryer device 10 very well in this position. However, the spring bias in ducts 20, 22 to clamp the device 10 securely to the boots 12 while clamping the two boots together provides an even more secure and stable unit, as described below.

The spring clip 122 includes two prongs 124, 126 extending downwardly into the ducts 20, 22 from a cross bar 128 positioned in the manifold 19. The spring clip 122 has a resilient bias such that the distal ends 125, 127 of the prongs 124, 126 approach each other and resist separation from each other. Consequently, the prongs 124, 126 hold the flexible duets 20, 22 biased toward each other so that they also resist separation from each other. The clip 122 is attached to the air duet assembly 18 so that the cross bar 128 and the prongs 124, 126 of the clip 122 are held in place by protrusions of the surfaces 74, 78 of the air deflector 64, the inside surfaces 92, 98 of the air duct tubes 94, 100, respectively, the inside bottom surface 130 of the manifold 19, and the surface 132 in the manifold 19, as shown in FIG. 5. The bias of the prongs 124, 126 and consequently duets 20, 22 toward each other securely damps the air duet assembly 18 onto the boots 12 while holding the boots 12 together as well, which provides a very stable unit for drying.

Figure 9:
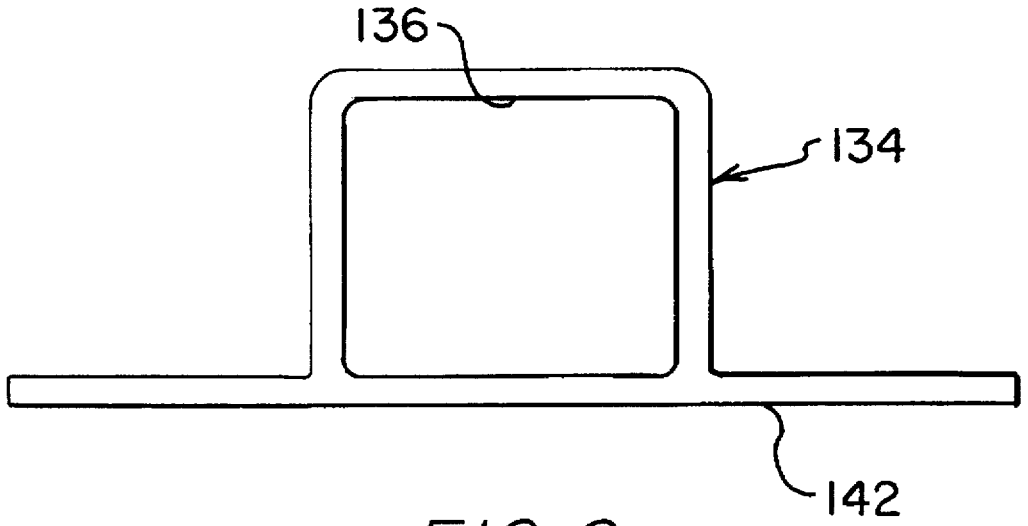
FIG. 9 is an enlarged front elevation view of the optional dryer stand used to hold the drying device in the inverted position for drying gloves or other clothing articles that do not have sufficient structural rigidity to support the dryer device, as shown in FIG. 2.

An optional feature of the drying device 10 includes the stand 134 shown in FIGS. 2 and 9. The stand 134 has an inside surface 136 so that the outside surface 138 of the air blower 16 and the outside surface 140 of the manifold 19 will fit snugly within the inside surface 136 of the stand 134 when the air blower 16 is connected to the duct assembly 18. The stand 134 also includes an elongated and substantially flat bottom surface 142 that effectively increases the support surface 55 of the drying device 10 for additional stability in the inverted position of FIG. 2. The stand 134 is used primarily when drying the gloves 14 or other clothing articles that have little or no structural rigidity of their own, as will be discussed in more detail below.

During operation and use of the drying device 10 to dry the boots 12, the air blower 16 is attached to the air duct assembly 18, as shown in FIG. 1. The optional nozzle 24, 26 can also be attached to the flexible hoses 20, 22, respectively. The flexible hoses 20, 22 and the nozzles 24, 26 are inserted into a pair of boots 12 so that the air blower 16 and the air duet assembly 18 are positioned near the top of the shafts 13 of boots 12, as shown in FIG. 1. Flexible ducts 20, 22 facilitate ease of entry of the ducts 20, 22 and the nozzles 24, 26 into the boots 12. The ducts 20, 22 and/or the nozzles 24, 26 can be adjusted longitudinally so that the proper length from the manifold 19 to the nozzle outlet 116 is obtained. More specifically, the ducts 20, 22 can be threaded into the ports 92, 98 and into the nozzles 24, 26 more or less to the extent necessary to obtain the desired length between the ports 102, 104 in the manifold 19 and the nozzles 24, 26. Due to the adjustment features of the drying device, it is possible to have the distance between the manifold 19 and the nozzle 24 be different than the distance between the manifold 19 and the nozzle 26, as shown in FIG. 3. In addition, it may be desirable with some boots 12 to remove the nozzles 24, 26 altogether, depending on the size, shape, and dimensions of the boots 12. It is also possible to adjust the nozzles 24, 26 rotationally so that the outlet port 116 of the nozzle 24 is angled differently than the outlet port 116 on the nozzle 26 or so that the nozzle 24 extends farther into the boot 12 than does the nozzle 26.

After the nozzles 24, 26 are positioned into a pair of boots 12, the air blower 16 can be switched on so that air A is sucked into the air blower 16 through the air blower entry ports 38, 40, heated if desired, and then forced into the air duct assembly 18. Upon reaching the air duct assembly 18, the air is deflected by the air deflector 64 in manifold 19 so that about one-half of the air flows into and through the port 94 and about one-half of the air A flows into and through the port 100. The air entering the port 94 exits the manifold 19 at the lower end 102 of the port 92 and enters the duct 20. Similarly, the air entering the port 100 exits the manifold 19 at the air duct exit port 104 and enters the duct 20.

The air entering and flowing through the duct 20 exits the duct 20 through the nozzle 24. Similarly, the air entering and flowing through the duct 22 exits the flexible hose 22 through the nozzle 26. The air A exiting the nozzles 24, 26 circulates through the inside surfaces of the boots 12, drying them, and eventually exits out the tops of the boots 12. The air A can be blown into the boots 12 as long as is necessary to dry the boots. If the clip 122 is used with the drying device 10, the bias of the clip 122 in the flexible ducts 20, 22 forcing them toward each other (see FIG. 6) helps to keep the pair of boots 12 positioned adjacent each other and helps to keep the drying device 10 positioned correctly during use, even if the boots 12 are somehow dislodged or knocked over, which is made even more unlikely by clamping the boots 12 together in this manner, as explained above.

During periods of non-use or travel, the drying device 10 can be disassembled and stored inside of the boots 12, with the blower device 16 and cord 30 stowed in one boot 12 and the air duct assembly 18 stowed in the other boot 12, as shown in FIG. 7. The flexible ducts 20, 22 can conform to the inside shape, size, and dimensions of the boots 12 to facilitate such storage. As previously discussed above, the air blower 16 has a shape that also allows it to be easily positioned and stored inside of a boot 12, and the nozzles can be turned around 180° for a better fit with the inlet 60 pointed forward toward the toe end 48 of the boot 12. In addition to saving space, storing the drying device 10 inside the boots 12 helps prevent the drying device 10 from becoming damaged or lost during periods of non-use or travel, and the user need only be concerned with carrying the boots 12 while the dryer device 10 is toted along inside the boots.

During operation and use of the drying device 10 to dry the gloves 14, the air blower 16 is attached to the air duct assembly 18 which is in turn attached to the ducts 20, 22, as previously discussed above and as shown in FIG. 2. The gloves 14 can be placed directly onto the ducts 20, 22, or the gloves 14 can be placed onto the nozzles 24, 26 after the nozzles have been attached to the ducts 20, 22, respectively. In contrast to the use of the drying device 10 to dry boots 12, where the drying device 10 is mounted on and supported by the boots 12, during the use of the drying device 10 to dry the gloves 14, the drying device 10 is supported by a surface (not shown) such as a table top or desk top. The air duct assembly 18 is attached to the blower device 16 in such a manner that the two flexible hoses 20, 22 extend upwardly. In order to provide more stability to the drying device 10 during this use, the optional stand 134 can be attached around the air blower 16 and the air duct assembly 18 to prevent the drying device 10 from tipping over. Therefore, the stand 134 is preferably positioned so that the elongated bottom surface 142 of the stand 134 is adjacent the surface (not shown) supporting the drying device 10. The substantially flat top surfaces 47, 55 of the air blower 16 and air duct assembly 18, respectively, also help provide stability to the drying device 10 when the drying device 10 is being used to dry the gloves 14 and is supporting the remainder of the drying device 1.

The optional clip 122 discussed above is particularly useful when the drying device 10 is being used to dry the gloves 14. If the optional clip 122 is used with the drying device 10, the bias of the clip 122 in the flexible hoses 20, 22 toward each other helps to keep the pair of gloves 14 held securely together and on the air duct assembly 18 so that they will not become dislodged or knocked off of the drying device 10 inadvertently.

The foregoing description is considered as illustrative only of the principles of the invention. For example, it should be apparent that the drying device 10 can be used to dry mittens, shoes, tubular objects, boots, and gloves having a variety of sizes and shapes. In addition, the drying device 10 can include a monitor thermostat (not shown) to automatically shut off the air blower 16 when the temperature inside the boots 12, gloves 14, or other item being dried becomes too hot. The air deflector 64 can also have various designs, so long as about half of the air from the air blower 16 is directed down each of the flexible hoses 20, 22. The air blower 16 and the air duct assembly 18 can also have a variety of surface structures, so long as the drying device 10 will remain stable when being used to dry gloves and mittens. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. Portable dryer apparatus for enhancing drying of clothing articles, including pairs of boots and pairs of gloves, wherein each of such boots has a sufficiently rigid structure comprising a foot section and a shaft section to stand erect and enclose an interior space that is generally in the shape of a person's foot, ankle, and lower leg extremity, said portable dryer apparatus comprising:

an air blower including a housing with an air inlet opening, a wide portion that encloses a motor and fan, and an outlet that narrows from said wide body portion into a barrel;

an air duct assembly with a manifold that has an inlet section attached to said barrel and two outlet ports, said barrel and said inlet section of the manifold forming together a conduit neck extending between the wide portion of the housing and said two outlet ports, and two ducts attached respectively to the two outlet ports of the manifold and extending in a direction generally perpendicular to the conduit neck, said housing, said manifold inlet section, and said ducts being sized or proportioned in relation to each other in such a manner that said ducts are insertable into the shaft sections of the boots to extend toward the foot sections while said conduit neck is positioned on and extends over the tops of the shaft sections to support the wide portion of the housing in a position outside and adjacent the tops of the shaft sections of the boots, and wherein said ducts are separable spatially, but resiliently biased toward each other such that they resist spatial separation and, when inserted into respective shafts of a pair of boots or into respective gloves of a pair of gloves, exert a clamping force to hold said boots or said gloves together between said ducts.

2. The portable dryer apparatus of claim 1, wherein said ducts are flexible.

3. The portable dryer apparatus of claim 1, wherein each of said ducts has a proximal end attached to the manifold and a distal end that is insertable into the shaft section of the boot, and said air duct assembly includes two nozzles mounted respectively on the distal ends of the two ducts.

4. The portable dryer apparatus of claim 3, wherein each nozzle has a discharge port that directs air from the duct into the foot section of the boot.

5. The potable dryer apparatus of claim 4, wherein the duct is adjustably connected to the manifold in such a manner that the nozzle is adjustable toward and away from the manifold.

6. The potable dryer apparatus of claim 4, wherein the nozzle is adjustably connected to the duct in such a manner that the nozzle is adjustable toward and away from the manifold.

7. The potable dryer apparatus of claim 1, wherein said manifold inlet is detachable from said barrel to separate said air blower from said air duct assembly.

8. The potable dryer apparatus of claim 7, wherein said air blower is small enough in physical size to be stowed in the interior space of one adult size boot, and wherein said air duct assembly is small enough in physical size to be stowed in the interior of another adult size boot.

9. The portable dryer apparatus of claim 1, wherein said air blower and said manifold together have a flat surface that is diametrically opposed to the direction in which the ducts extend such that the potable dryer apparatus is supportable in a stable position on said flat surface with the ducts extending upwardly into a pair of gloves or other clothing article to support the pair of gloves or other clothing article on the ducts while air is delivered from the air blower via said manifold and ducts into the gloves or other clothing article.

10. Air dryer apparatus, comprising:

an air blower; and an air duct assembly connected to the air blower, said air duct assembly including a manifold with an inlet port and two outlet ports, two flexible ducts, each of which has a proximal end connected respectively to said outlet ports of the manifold and a distal end, said distal ends being moveable toward and away from each other, and a spring connected to said flexible ducts in a manner that yieldingly resists any force that tends to move said distal ends away from each other and, when such force is ended, resiliently tends to move said distal ends back toward each other.

11. The air dryer apparatus of claim 10, wherein said spring bias means includes a spring clip having two prongs adjacent each other and depending from a cross bar with a resilient bias that resists separation of the prongs from each other, said spring clip being positioned with the cross bar in the manifold and the prongs extending respectively through said ports into said flexible ducts.

12. The air dryer apparatus of claims 10, wherein said air duct assembly is disconnectable from said air blower.

13. The air dryer apparatus of claim 12, wherein said air duct assembly is connectable to said air blower with said manifold oriented with said flexible ducts extending downwardly and alternatively connectable to said air blower with said flexible ducts extending upwardly.

14. The air dryer apparatus of claim 10, wherein each of said flexible ducts has a proximal end connected to said manifold and a distal end, and a nozzle connected on the distal end of each flexible duct for directing air that flows from the air blower through the manifold and flexible ducts into an article to be dried.

15. The air dryer apparatus of claim 14, wherein said nozzles are adjustable rotationally and longitudinally in relation to said flexible ducts.

16. The air dryer apparatus of claim 14, wherein said flexible ducts are adjustable longitudinally in relation to said ports in said manifold.

17. The air dryer apparatus of claim 13, including a flat surface on said manifold and air lower opposite said flexible ducts when said manifold is oriented with the flexible ducts extending upwardly.

18. The air dryer apparatus of claim 17, including a stand attachable to and detachable from the manifold and air blower with an extended flat surface that is opposite the upwardly extending flexible ducts.

19. A drying device, comprising:

an air blower having a substantially flat top surface and an elongated air exit port;

a duct assembly having a manifold with an air entry port, two air exit ports each of which has a circular cross section, an inner surface, and at least one protruding thread located on said inner surface, an air deflector disposed between said air entry port of said duct assembly and said two air exit ports of said manifold, and a substantially flat top surface, wherein said air entry port of said manifold can be removably connected to said elongated air exit port of said air blower such that said substantially flat top surface of said air blower forms a substantially continuous flat surface with said substantially flat top surface of said duct assembly;

said duct assembly also having two flexible hoses, each of which has a circular cross section, an outer surface, and a thread located on said outer surface, wherein said two flexible hoses can be removably inserted into said two air exit ports of said manifold and removably attached to said two air exit ports of said manifold by mating said threads on said outside surfaces of said two flexible hoses with said threads on said inside surfaces of said two air exit ports of said manifold; and biasing means connected to said manifold and to said two flexible hoses for biasing said two flexible hoses toward each other.

20. The drying device of claim 19, including a nozzle having a first end and a second end, said first end of said nozzle having a circular cross section, an inner surface, and at least one raised thread on said inner surface, wherein one of said flexible hoses can be removably inserted into said first end of said nozzle and removably attached to said first end of said nozzle by mating said thread on said inner surface of said first end of said nozzle with said thread on said outside surface of said flexible hose.

21. The drying device of claim 20, wherein said nozzle is L-shaped and said second end of said nozzle is perpendicular to said first end of said nozzle.

22. The drying device of claim 20, including a stand having an elongated and substantially flat support surface that can be removably attached to said drying device.

23. The drying device of claim 22, wherein said stand can be removably attached to said drying device approximately where said air entry port of said duet assembly is removably connected to said elongated air exit port of said air blower such that said elongated and substantially flat support surface of said stand is approximately parallel to said substantially flat continuous surface formed by said substantially flat top surface of said air blower and said substantially flat top surface of said duct assembly.

24. The drying device of claim 19, wherein each of said two air exit ports of said manifold has a prong extending outward from said manifold and into said flexible hose connected to said air exit port of said manifold to form said biasing means.

25. The drying device of claim 19, wherein said biasing means includes at least one prong connected to said duct assembly such that said prong extends longitudinally into one of said two flexible hoses.

26. The drying device of claim 19, wherein said air blower includes a battery that powers the air blower electrically.

27. A drying device, comprising:

a housing having a substantially flat top surface, an air entry port, an elongated air exit port, and blower means for blowing air out of said elongated air exit port of said housing;

a duct assembly having a manifold with an air deflector, an air entry port, two air exit ports, and a substantially flat top surface, wherein said air entry port of said duct assembly can be removably connected to said elongated air exit port of said housing such that said substantially flat top surface of said housing forms a substantially continuous flat surface with said substantially flat top surface of said duct assembly;

two flexible hoses;

attachment means located on each of said two flexible hoses and said manifold for removably attaching each of said two flexible hoses to one of said air exit ports of said manifold such that said two flexible hoses extend away from said manifold and are substantially parallel and each of said two air exit ports of said manifold is attached to one of said two flexible hoses; and biasing means connected to said duct assembly and to said two flexible hoses for biasing said two flexible hoses toward each other.

28. The drying device of claim 27, including a nozzle having a first end and a second end, and connection means located on said first end of said nozzle and each of said two flexible hoses for removably connecting said first end of said nozzle to one of said two flexible hoses.

29. The drying device of claim 28, wherein said second end of said nozzle includes an air outlet port.

30. The drying device of claim 27, including support means removably attached to said drying device and having an elongated and substantially flat support surface for supporting said drying device.

31. The drying device of claim 27, wherein said biasing means includes at least one prong connected to said manifold such that said prong extends longitudinally into one of said two flexible hoses.

32. The drying device of claim 31, wherein said biasing means includes two prongs connected to said manifold such that each of said prongs extends longitudinally into one of said two flexible hoses and each of said two flexible hoses contains only one of said two prongs.

33. Air dryer apparatus for drying insides of two objects that have hollow interiors and openings to said hollow interiors, comprising:

two elongated ducts, each of which has a proximal end connected to a source of drying air and a distal end adapted for insertion through the opening and into the hollow interior of one of said objects, said distal ends of said duct being moveable toward and away from each other while said proximal ends of said ducts are fixed in immoveable relation to each other, said ducts being resiliently biased toward each other with sufficient resistance to movement of the distal ends of said ducts away from each other to apply a clamping force on portions of said objects that are positioned between said distal ends that can hold said objects from separating from each other when said distal ends are inserted into respective opposite hollow interiors of said objects and to resist removal of said distal ends from said hollow interiors.

* * * * *